United States Patent [19]

Sakamoto et al.

[11] Patent Number: 4,823,121

[45] Date of Patent: Apr. 18, 1989

[54] ELECTROLUMINESCENT PANEL DRIVING SYSTEM FOR DRIVING THE PANEL'S ELECTRODES ONLY WHEN NON-BLANK DATA IS PRESENT TO CONSERVE POWER

[75] Inventors: Atsushi Sakamoto, Yamatokoriyama; Shigeyuki Harada; Toshihiro Ohba, both of Nara, all of Japan

[73] Assignee: Sharp Kabushiki Kaisha, Osaka, Japan

[21] Appl. No.: 918,902

[22] Filed: Oct. 15, 1986

[30] Foreign Application Priority Data

Oct. 15, 1985 [JP] Japan ..... 60-230659

[51] Int. Cl.[4] ..... G09G 3/30

[52] U.S. Cl. ..... 340/781; 340/805; 340/825.81; 315/169.3

[58] Field of Search ..... 340/781, 753, 754, 825.81; 315/169.1, 169.3

[56] References Cited

U.S. PATENT DOCUMENTS

| | | | |
|---|---|---|---|
| 3,885,196 | 5/1975 | Fischer | 340/781 |
| 4,032,818 | 6/1977 | Chan | 315/169.2 |
| 4,187,505 | 2/1980 | Morley et al. | 340/753 |
| 4,247,855 | 1/1981 | Uede et al. | 340/753 |
| 4,338,598 | 7/1982 | Ohba et al. . | |
| 4,485,379 | 11/1984 | Kinoshita et al. | 340/825.81 |

FOREIGN PATENT DOCUMENTS

| | | |
|---|---|---|
| 54-130898 | 3/1978 | Japan . |
| 2135099 | 1/1984 | United Kingdom . |
| 2149182A | 6/1985 | United Kingdom . |
| 2158982A | 11/1985 | United Kingdom . |

OTHER PUBLICATIONS

Nikkei Electronics, Apr. 2, 1979, "Practical Applications of Thin-Film Electroluminescent (EL) Character Display".

*Primary Examiner*—John W. Caldwell, Sr.
*Assistant Examiner*—Jeffery A. Brier
*Attorney, Agent, or Firm*—Birch, Stewart, Kolasch & Birch

[57] ABSTRACT

An EL (electroluminescent) panel driving system includes a display control circuit for producing, line by line, an image data. The image data of each line is defined by a combination of a HIGH level signal representing a spot illumination of the EL panel and a LOW level signal representing a non-illumination of a spot on the EL panel. The system further includes a pre-charge circuit and a pull-up charge circuit for providing a first range voltage to the EL panel at the beginning of each line scan operation to make the EL panel ready to illuminate, and a write-in circuit and a source level switching circuit for providing a second range voltage to the EL panel to permit the spot illumination of the EL panel in accordance with the HIGH level signals contained in the image data. These four circuits are turned on by four signals. The driving system also includes a detector that detects when no HIGH level signal are present in the image data of a line, an AND gate array for cutting off the four signals from the pre-charge circuit, pull-up circuit, write-in circuit, and source circuit, the four circuits are prevented from being actuated, thereby cutting off the power normally supplied during the blank line scanning to save power.

14 Claims, 7 Drawing Sheets

FIELD
SCAN PERIOD
PRE-CHARGE 80 (S1)
PULL-UP CHARGE 90 (S2)
WRITE-IN 100
(S31)
(S32)
SOURCE LEVEL S. 110(S4)
N-ch MOS IC 60
Nt1~Ntj(≒2)
Nt2
N-ch MOS IC 20
NTi~NTi-1(≒3)
NT3
N-ch MOS IC 30
NT4~NTi
NT2
P-ch MOS IC 40
PTi~PTi-1(≒3)
PT3
P-ch MOS IC 50
PT4~PTi
PT2
ON
OFF
N-ch FIELD
P-ch FIELD
LINE X2
LINE X3
T1
T2
T3
T1'
T2'
T3'
P1
P2
P3
P4
P5
P6
P7
P8

ELECTROLUMINESCENT PANEL DRIVING SYSTEM FOR DRIVING THE PANEL'S ELECTRODES ONLY WHEN NON-BLANK DATA IS PRESENT TO CONSERVE POWER

RELATED APPLICATIONS

U.S. patent application Ser. No. 664,958 filed Oct. 26, 1984 (counterpart to UK Pat Application published June 5, 1985 as GB No. 2 149 182 A) U.S. patent application Ser. No. 718,239 filed Apr. 1, 1985, (counterpart to UK Pat Application published Nov. 20, 1985 as GB No. 2 158 982 A)

Both of which are assigned to the same assignee as the present application.

BACKGROUND OF THE INVENTION

1. Field of the Invention

The present invention relates to a drive system for a thin-film electroluminescent (EL) display panel, and more particularly, to an improvement of the EL panel drive sysems which can save electric power.

2. Description of the Prior Art

A thin-film EL display panel 10, such as shown in FIG. 1, includes a transparent glass plate 1 on which transparent stripe electrodes 2 are deposited parallel to each other. Then, a layer 3 made of a transparent dielectric material is deposited over the electrodes 2, and an EL layer 4 is deposited on dielectric layer 3. Another layer 5 made of a dielectric material is deposited on the EL layer 4, and stripe electrodes 6 are deposited, orthogonal to stripe electrodes 2, on dielectric layer 5. At the crossing point of two electrodes 2 and 6, the EL layer 4 generates a spot of light which can be viewed through glass plate 1. Thus, by illuminating a number of spots, an image can be produced on the EL display panel.

According to the prior art, there are two method to drive the EL panel: one method is called the field refresh driving method; and the other is called the P-N alternating method. The present invention is particularly concerned with the P-N alternating method in which writing operations for the P-ch field and N-ch field are carried out alternately.

An example of a prior art EL panel drive system employing the P-N alternating method is shown in FIG. 2, and is disclosed, for example, in U.S. patent application Ser. No. 718,239, filed Apr. 1, 1985 (a counterpart to UK patent application published Nov. 20, 1985 as GB No. 2,158,982 A) and assigned to the same assignee as the present application.

In FIG. 2, EL panel 10 includes a plurality of data electrodes Y1, Y2, . . . , and Yj, and a plurality of scan electrodes X1, X2, X3, . . . , and Xi. Every other scan electrodes with odd numbers X1, X3, . . . , and Xi-1 are connected to an odd side N-ch high voltage MOS IC 20, which includes N-type MOS transistors NT1, NT3, . . . , and NTi-1. These transistors are activated by signals from a shift register 21. Similarly, the even number scan electrodes X2, X4, . . . , and Xi are connected to an even side N-ch high voltage MOS IC 30, which includes N-type MOS transistors NT2, NT4, . . . , and NTi. These transistors are activated by signals from a shift register 31.

Also, the odd number scan electrodes X1, X3, . . . , and Xi-1 are connected to an odd side P-ch high voltage MOS IC 40, which includes P-type MOS transistors PT1, PT3, . . . , and PTi-1. These transistors are activated by signals from a shift register 41. Similarly, the even number scan electrodes X2, X4, . . . , and X1 are connected to an even side P-ch high voltage MOS IC 50, which includes P-type MOS transistors PT2, PT4, . . . , and PTi. These transistors are activated by signals from a shift register 51.

The data electrodes Y1, Y2, . . . , and Yj are connected to a data side N-ch high voltage MOS IC 60, which includes N-type MOS transistors Nt1, Nt2, . . . , and Ntj. These transistors are activated by a shift register 61. A data side diode array 70 is provided for separating the data side driving line and for preventing the application of a reverse biased voltage to the swiching transistors.

A picture element is defined at each crossing point of the scan electrode and the data electrode, which illuminates when a predetermined voltage, such as 220 volts, is applied across the scan and data electrodes. By using different combinations of illuminated dots, various characters and pictures can be produced on the EL panel.

The circuit shown in FIG. 2 further includes a precharge circuit 80, a pull-up charge circuit 90, a write-in circuit 100 and a source level switching circuit 110 which are operated in response to signals S1, S2, S31 (and/or S32) and S4 produced from a display control circuit (not shown).

Operation of the EL Drive System of FIG. 2

The operation of the EL drive system of FIG. 2 will be described below with reference to FIGS. 3 and 4.

Referring to FIG. 3, the time chart shown therein indicates that operations for an N-ch field and a P-ch field are carried out alternately such that during the operation of the N-ch field, the scan and data electrodes are applied with the predetermined voltage (220 volts) having a positive polarity to illuminate the picture element, whereas during the operation of the P-ch field, the same scan and data electrodes are applied with the predetermined voltage having a negative polarity to illuminate the same picture element. Thus, one frame of the picture is defined by one N-ch field and one P-ch field. During the operation of the N-ch field, all the scan lines X1, X2, X3, . . . , Xi-1 and Xi are scanned. Each scan operation includes three stages T1, T2 and T3 as shown in FIG. 3. Similarly, During the operation of the P-ch field, all the scan lines X1, X2, X3, . . . , Xi-1 and Xi are scanned. Each scan operation includes three stages T1', T2' and T3' as shown in FIG. 3.

Signals S1, S2, S31, S32 and S4 are provided to activating circuits 80, 90, 100 and 110 in the following manner.

Signals S1, S2, S32, S32 and S4 During the N-ch Field

Signal S1 is at a level that turns the precharge circuit 80 on to produce a pre-charge voltage (30 volts) during the first stage Ti; signal S2 is at a level that turn the pull-up charge circuit 90 on to produce a pull-up voltage (30 volts) during the latter half of the second stage T2; and signal S31 is at a level that turns the write-in circuit 100 on to produce a first illuminating voltage (190 volts) during the third stage T3. Also, during the operation of the N-ch field, signal S32 is at a level that maintains the write-in circuit 100 to produce the first illumination voltage (190 volts), and signal S4 is at a level that enables the source level switching circuit 110 to connect line L1 to ground during the operation of the N-ch field.

Signals S1, S2, S32, S32 and S4 During the P-ch Field

Signals S1, S2 and S3 for the P-ch field, during stages T1', T2' and T3' are at the same level as in stages T1, T2 and T3, thereby the operating circuits 80, 90 and 100 operate in the same manner as described above in the N-ch field. However, signal S32 is at a level, simultaneously with signal S31, that turns the write-in circuit 100 on to produce a second illumination voltage (220 volts) during the third stage T3'. In addition, signal S4 is at a level that enables the source level switching circuit 110 to connect line L1 to a source voltage (30 volts) during the third stage T3'.

The Control of Illumination of the Picture Elements

In operation, it is assumed that a picture element A on line X2 shown in FIG. 2 is illuminated, and all the other picture elements, including picture element C, on the same line X2 are not illuminated. Also, it is assumed that all the other picture elements on line X3, including picture element B, are not illuminated.

To cause the illumination of the picture element A during the N-ch field, the transistor Nt2 is turned off as indicated at P1 in FIG. 3. The non-illuminated condition of the picture elements on line X2 other than the picture element A during the N-ch field is caused by the turning of transistors Nt1, Nt3-Ntj as indicated at P2 in FIG. 3.

Also, the illumination of the picture element A and the non-illumination of the other picture elements on line X2 during the P-ch field are caused, respectively, by the turning on of transistor Nt2 as indicated at P3 and the turning off of transistors Nt1, Nt3-Ntj as indicated at P4 in FIG. 3.

Furthermore, the non-illumination of the picture elements on line X3 during the N-ch field is caused by the turning on of transistors Nt1-Ntj as indicated at P5 and P6. Also, the non-illumination of the picture elements on line X3 during the P-ch field is caused by the turning off of transistors Nt1-Ntj as indicated at P7 and P8.

The turning on and off of transistors Nt1-Ntj is controlled by the image data signal applied to shift register 61 in the data side N-ch high voltage MOS IC 60 during stage T2 during every line scan period. The image data is produced, line by line, from a display control circuit. The image data of each line is defined by a combination of a HIGH level signal representing a spot of illumination on the EL panel and a LOW level signal representing a non-illumination of a spot on the EL panel.

Next, the operation of the EL drive system of FIG. 2 in each stage will be described below with reference to FIGS. 2 and 3 and also Tables 1 and 2.

TABLE 1

(N-ch Field)

| | | T1 | T2 | T3 |
|---|---|---|---|---|
| | | Cir. 80 on | Cir. 90 on | Cir. 100 on (190 V) |
| | | PT1-PTi off | PT1-PTi on | PTeven off |
| | | | | PTodd on |
| | | NT1-NTi on | NT1-NTi off | NT2 on |
| | | Nt1-Ntj off | Nt2 off | Nt1-Ntj off |
| | | | Nt1, Nt3-Ntj on | |
| A | Y2 | 30 | 30 60 | (30) 220 |
| | X2 | 0 | 0 30 | (0) 0 |
| C | Y1 | 30 | 0 0 | (−30) 160 |
| | X2 | 0 | 0 30 | (0) 0 |

N-ch Field Operation

In the N-ch field, the source level switching circuit 110 is activated by signal S4 to connect line L1 to ground.

N-ch Field First Stage T1 (Pre-charge Period)

In the first stage T1, all the transistors Nt1-Ntj are turned off by the signal temporarily stored in shift register 61. Also, tansistors NT1-Nti are turned on and transistor PT1-PTi are turned off. Then, circuit 80 is turned on to provide a pre-charge voltage (30 volts) through diode array 70 to lines Y1-Yj. Thus, in the first stage T1, lines Y1-Yj are held at 30 volts and lines X1-Xi are held at 0 volt.

For the sake of brevity, the description hereinbelow is directed to the horizontal line X2 and vertical lines Y1 and Y2 to discuss specifically the illuminating of picture element A and nonilluminating of picture element C. The voltage changes in these lines, as well as the changes in the various transistors, are indicated in Table 1.

N-ch Field Second Stage T2 (Discharge/Pull-Up Charge Period)

During the first half period of the second stage T2, transistors Nt1, Nt3-Ntj turn on and transistor Nt2 is turned off by a next signal, which is the image data signal, temporarily stored in shift register 61. Also, transistors PT1-PTi are turned on and transistors NT1-NTi are turned off. Thus, line X2 is grounded through transistor PT2 and diode 101, to maintain line X2 at 0 volt. Also, lines Y1 and Y3-Yj are grounded through transistors Nt1 and Nt3-Ntj, respectively, but line Y2 is maintained floating carrying 30 volts. This is done in the first half period in the second stage T2, as indicated in Table 1.

Then, in the second half period of the second stage T2, the pull-up charge circuit 90 turns on to provide a pull-up voltage (30 volts) through transistor PT2 to line X2. Thus, line X2 carries 30 volts. At this time, since line Y2 is floating, the voltage on line X2 is added with the voltage on line Y2 by the capacitive coupling effect at the picture element A, thereby increasing the voltage on line Y2 to 60 volts. However, since other lines Y1, Y3-Yj are grounded, these lines are still maintained at 0 volt, as indicated in Table 1.

lines X1-Xi, thereby completing one driving operation of the N-ch field.

Next, the operation of the EL panel driving system during the P-ch field will be described with reference to FIGS. 2 and 3 and Table 2 shown below.

TABLE 2

(P-ch Field)

| | | T1' | T2' | T3' |
|---|---|---|---|---|
| | | Cir. 80 on | Cir. 90 on | Cir. 100 on (220 V) |
| | | | | Cir. 110 on (30 V) |
| | | PT1-PTi off | PT1-PTi on | PT2 on |
| | | | | PT1, PT3-PTi off |
| | | NT1-NTi on | NT1-NTi off | NTeven off |
| | | | | NTodd on |
| | | Nt1-Ntj off | Nt2 on | Nt1-Ntj off |
| | | | Nt1, Nt3-Ntj off | |
| A | Y2 | 30 | 0 0 | 0 |
| | X2 | 0 | 0 30 | 220 |
| C | Y1 | 30 | 30 60 | 60 |
| | X2 | 0 | 0 30 | 220 |

N-ch Field Third Stage T3 (Write-In Period)

In the third stage T3, all the transistors Nt1-Ntj are turned off making all the lines Y1-Yj float, and only transistor NT2 is turned on to drop the voltage on line X2 to 0 volts. The 30 volt drop on line X2 causes a 30 volt drop in all the lines Y1-Yj. Thus, line Y1, which has been carrying 0 volts, drops to −30 volts, and line Y2, which has been carrying 60 volts, drops to 30 volts.

Then, in the third stage T3, transistors PT2, PT4, . . . provided in the even side P-ch high voltage MOS IC 50 are turned off, and transistors PT1, PT3, . . . provided in the odd side P-ch high voltage MOS IC 40 are turned on. Also, the write-in circuit 100, which is activated by signal S31, produces the first illuminating voltage (190 volts). The first illuminating voltage (190 volts) is applied through transistors PT1, PT3, . . . to odd number horizontal lines X1, X3, . . . so that 190 volts is further added to floating lines Y1-Yj. Thus, floating line Y1 now carries 160 volts and floating line Y2 now carries 220 volts. At this time, since the even number horizontal line X2 is at 0 volt, the voltage difference between lines X2 and Y2 at picture element A is 220 volts. The voltage difference between lines X2 and Y1 at picture element C is 160 volts, provided that the voltage level at line X2 is considered as a reference voltage. Since the EL layer 4 employed in this example has an illumination threshold level of about 190 volts, it illuminates when 220 volts is applied across it in the thickness direction and it hardly illuminates when 160 volts is applied across it. Thus, in the above described operation, the picture element A will be illuminated and the picture element C will not be illuminated. It is also noted that the voltage changes observed at the beginning of the third stage T3, as indicated in parentheses in Table 1, do not actually occur, but are observed as a transient state.

Although the above description is specifically directed to the scanning line X2, the above described operation is repeated sequentially for all the scanning P-ch Field Operation In the P-ch field, the source level switching circuit 110 is activated by signal S4 to connect line L1 to ground during stages T1' and T2' and to 30 volts during stage T3'.

P-ch Field First Stage T1' (Pre-charge Period)

The operation during the first stage T1' is the same as that in the first stage T1 for the N-ch field. Thus, by the signal temporarily stored in shift register 61 causes all the transistors Nt1-Ntj to turn off. Also, transistors NT1-NTiare turned on and transistor PT1-PTi are turned off. Then, circuit 80 is turned on to provide a pre-charge voltage (30 volts) through diode array 70 to lines Y1-Yj. Thus, during the first stage T1', lines Y1-Yj are held at 30 volts and lines X1-Xi are held at 0 volt.

The description hereinbelow is particularly directed to the horizontal line X2 and vertical lines Y1 and Y2 to discussed specifically the illuminating of picture element A and non-illuminating picture element C. The voltage changes in these lines, as well as the changes in the various transistors, are indicated in Table 2.

P-ch Field Second Stage T2' (Discharge/Pull-Up Charge Period)

During the first half period of the second stage T2', transistors Nt1-Ntj operate oppositely to those in the second stage T2. Thus, transistors Nt1, Nt3-Ntj are turned off and transistor Nt2 turns on. Also, transistors PT1-PTi are turned on and transistors NT1-NTi are turned off. Thus line X2 is grounded through transistor PT2 and diode 101 to maintain line X2 at 0 volt. Also, line Y2 is grounded through transistor Nt2, but lines Y1 and Y3-Yj are maintained floating carrying 30 volts. This is done during the first half period in the second stage T2', as indicated in Table 2.

Then, during the second half period of the second stage T2', the pull-up charge circuit 90 turns on to provide a pull-up voltage (30 volts) through transistors PT1-PTi to lines X1-X. Thus, line X2 carries 30 volts. At this time, since line Y1 is floating, the voltage on line X2 is added with the voltage on line Y1 by the capacitive coupling effect at the picture element C and other picture elements along line Y1, thereby increasing the voltage on line Y1 to 60 volts. However, since line Y2 is grounded, line Y2 is maintained at 0 volt, as indicated in Table 2.

P-ch Field Third Stage T3' (Write-In Period)

During the third stage T3', all the transistors Nt1-Ntj are turned off making all the lines Y1-Yj float, and only transistor PT2 is turned on. Also, transistors NT2, NT4, . . . provided in the even side N-ch high voltage MOS IC 30 are turned off, and transistors NT1, NT3, . . . provided in the odd side N-ch high voltage MOS IC 20 are turned on. Furthermore, the source level switching circuit 110 is activated by signal S4 to provide a predetermined source voltage (30 volts) to line L1 and, at the same time, the write-in circuit 100, activated by signals S31 and S32, produces the second illuminating voltage (220 volts).

Accordingly, line X3, as the well as other odd numbered horizontal lines, which has been carrying 30 volts in the previous stage T2', continues to carry 30 volts provided from the source level switching circuit 110 through transistor NT3 and also through other transistors NT1, NT5, NT7, . . . Thus, lines Y1 and Y2 are fixed and continue to hold 60 volts and 0 volt, respectively. Then, the second illuminating voltage (220 volts) is applied through transistor PT2 to line X2. At this time, if the voltage level at line X2 is considered as a reference voltage, the voltage difference between lines X2 and Y2 at picture element A is −220 volts, and the voltage difference between lines X2 and Y1 at picture element C is −160 volts. Thus, the picture element A will be illuminated and the picture element C will not be illuminated.

Although the above description is specifically directed to the scanning line X2, the above described operation is repeated sequentially for all the scanning lines X1-Xi, thereby completing one driving operation of the P-ch field.

Problems to be Solved

When an image is displayed on the EL panel, there are cases in which no illuminating picture element is present in the line to be scanned. For example, when words are displayed in lines with a large line spacing on the EL panel, there will be scanning lines with no illuminating picture elements. Also, when only 5 lines are used to write sentences, and the EL panel has a size which can accommodate 20 lines, 15 lines will remain blank, i.e., no illuminating picture elements are contained therein.

Even in such cases as explained above, according to the prior art EL panel drive system, the scanning lines with no illuminating picture element are also so scanned with the normal driving operation. The operation utilizes the actuation of pre-charge circuit 80, pull-up charge circuit 90, write-in circuit 100 and source level switching circuit 110. In other words, the scanning operation of the line with no illuminating picture element, which is called blank line scanning operation, is carried out with the voltage supplied from the circuits 80, 90, 100 and 110 for no substantial reason. This will result in unnecessary power consumption. Also, because the voltage is constantly applied across the EL layer, the EL layer may loose its functionability after a certain period of use.

SUMMARY OF THE INVENTION

The present invention substantially solves the above described problems Its essential object is to provide an improved EL panel driving system which can save power by disabling the circuits 80, 90, 100 and 110 during the blank line scanning operation.

It is also an essential object of the present invention to provide an improved EL panel driving system which can make the EL layer to last longer.

To accomplish these and other objects, an EL (electroluminescent) panel driving system according to the present invention comprises: a detecting circuit for detecting the presence of at least one HIGH level signal in the image data for one line of the EL panel to produce a presence signal if a HIGH level signal is detected, and for detecting the complete absence of the HIGH level signal in the image data for one line to produce an absence signal if a HIGH signal is not detected. Also, the present invention includes a control circuit for enabling the pre-charge circuit 80, pull-up charge circuit 90, write-in circuit 100 and source level switching circuit 110 when the presence signal is produced, and for disabling these circuits 80, 90, 100 and 110 when the absence signal is produced.

When the system of the prsent invention is employed, the power supplied to the circuits 80, 90, 100 and 110 is cut off during the blank line scanning operation to save power.

BRIEF DESCRIPTION OF THE DRAWINGS

These and other objects and features of the present invention will become apparent from the following description of a preferred embodiment with reference to the accompanying drawings, throughout which like parts are designated by like reference numerals, where.

DESCRIPTION OF THE PREFERRED EMBODIMENTS

Figure 1:
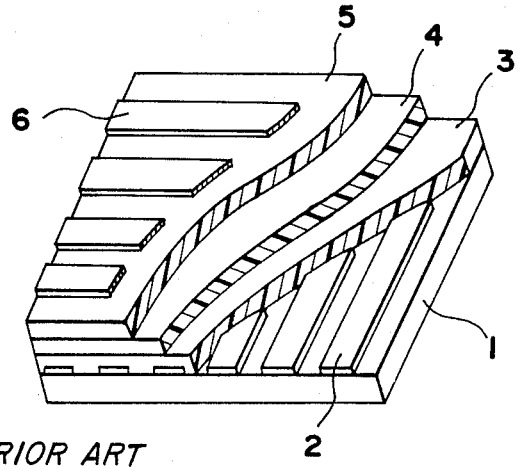
Fig. 1 PRIOR ART
FIG. 1 is a perspective fragmentary perspective view of an EL panel.
Figure 4:
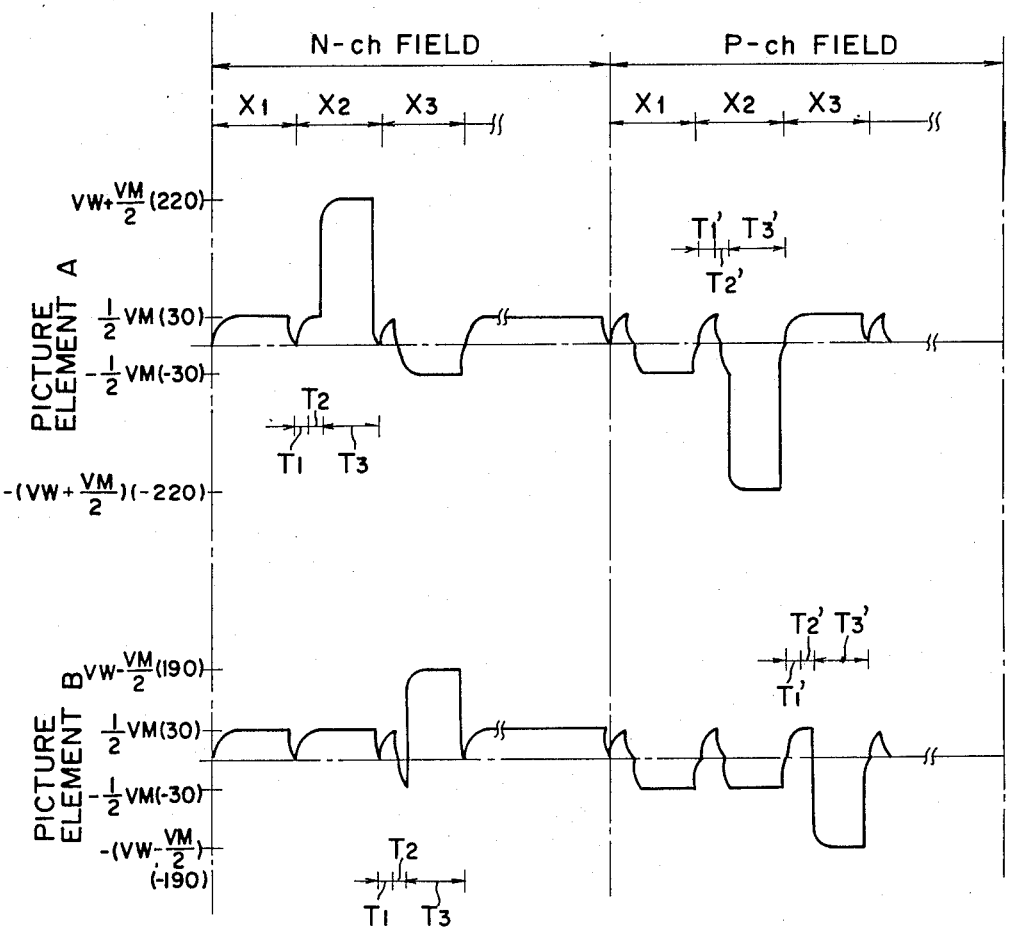
Fig. 4 PRIOR ART
FIG. 4 is a graph showing waveforms of the voltage applied across the EL panel using the prior art EL panel drive circuit of FIG. 2.
Figure 2:
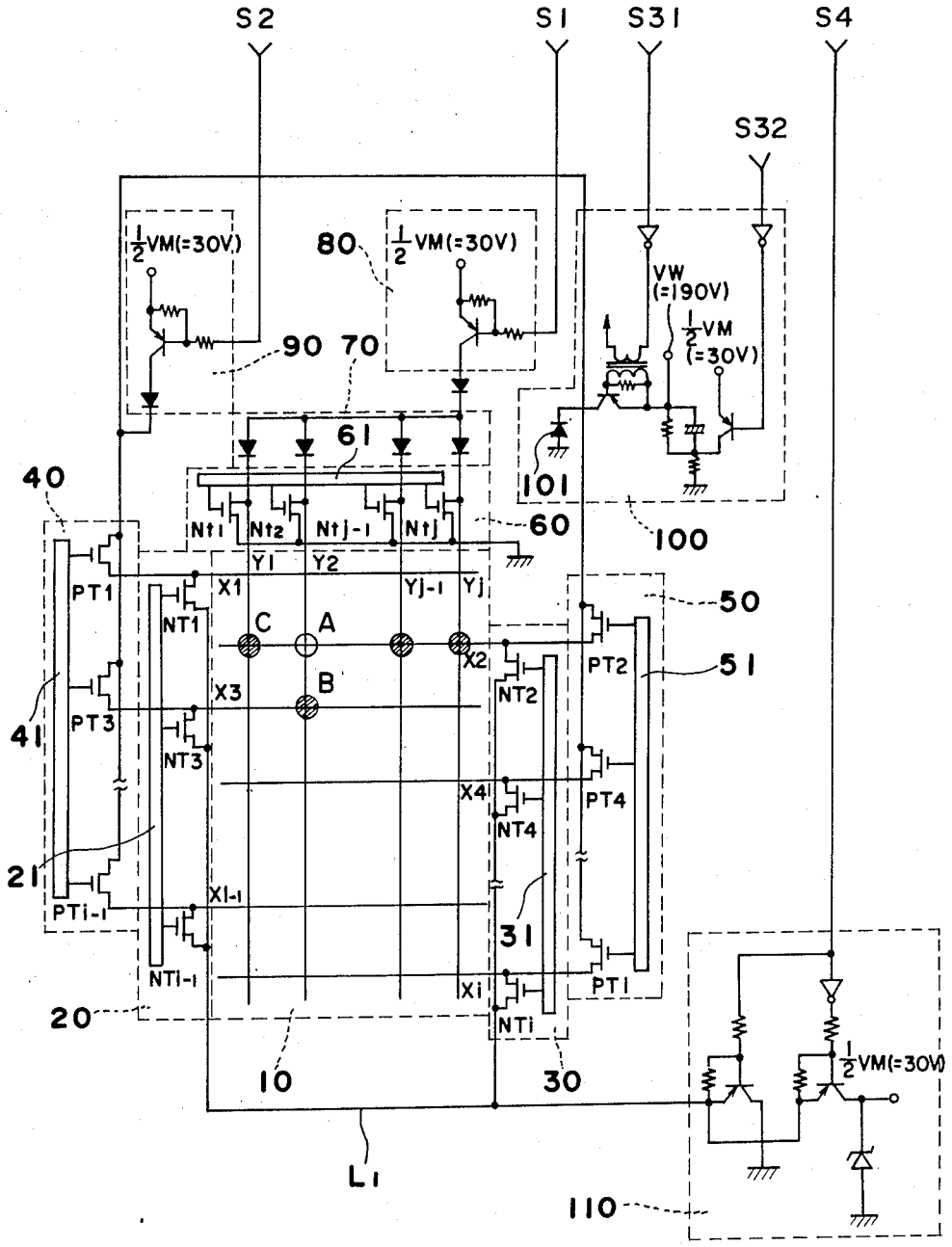
Fig. 2 PRIOR ART
FIG. 2 is a circuit diagram of an EL panel drive circuit according to the prior art.
Figure 3:
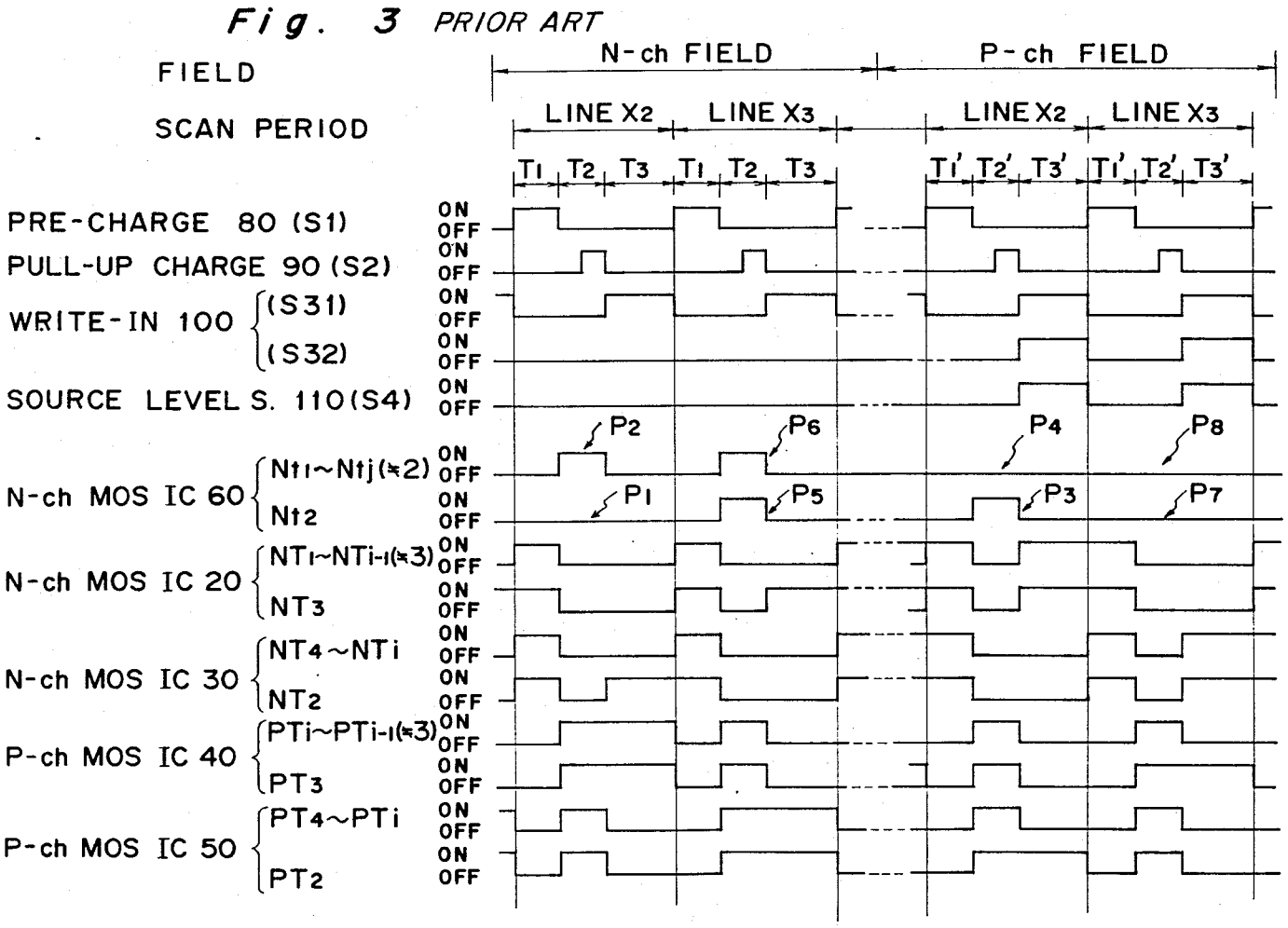
Fig. 3 PRIOR ART
FIG. 3 is a graph showing the on and off states of the various circuits and transistors provided in the circuit of FIG. 2.
Figure 5:
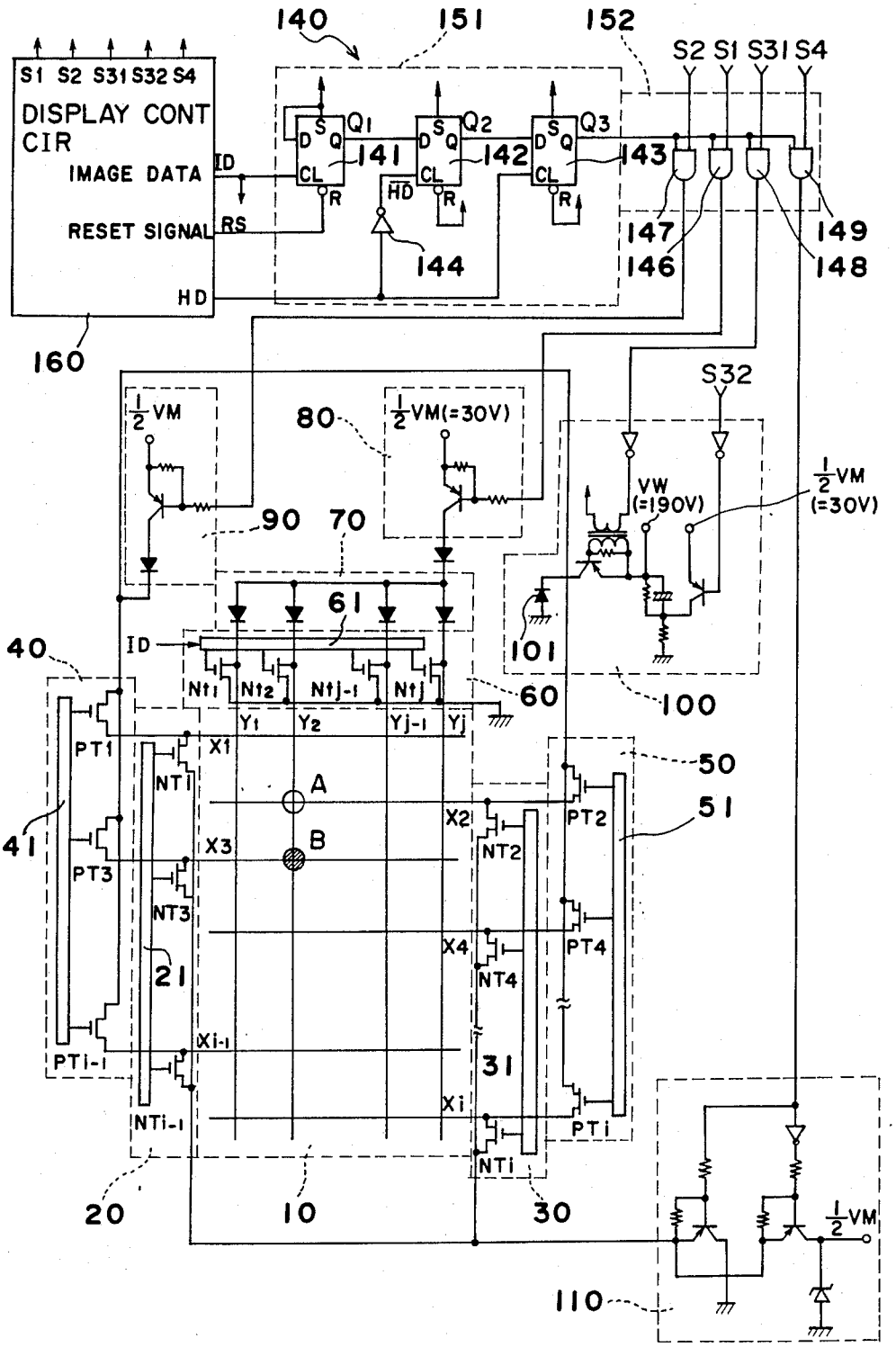
FIG. 5 is a circuit diagram of an EL panel drive circuit according to the present invention.

Referring to FIG. 5, an EL panel drive circuit according to the present invention is shown. When the circuit of FIG. 5 is compared with the prior art circuit of FIG. 2, a gate circuit 140 has been further provided so as to disable the supply of signals S1, S2, S31 and S4 when they are not necessary, in other words, when a scanning line with no illumination picture element is detected. Gate circuit 140 further comprises a condition detection circuit 151 and a gate array 152.

Condition detection circuit 151 including flip-flops 141, 142 and 143 are connected cascade. The the Q terminal of flip-flop 141 is connected to the D terminal of flip-flop 142 and the Q terminal of flip-flop 142 is connected to the D terminal of flip-flop 143.

Figure 6:
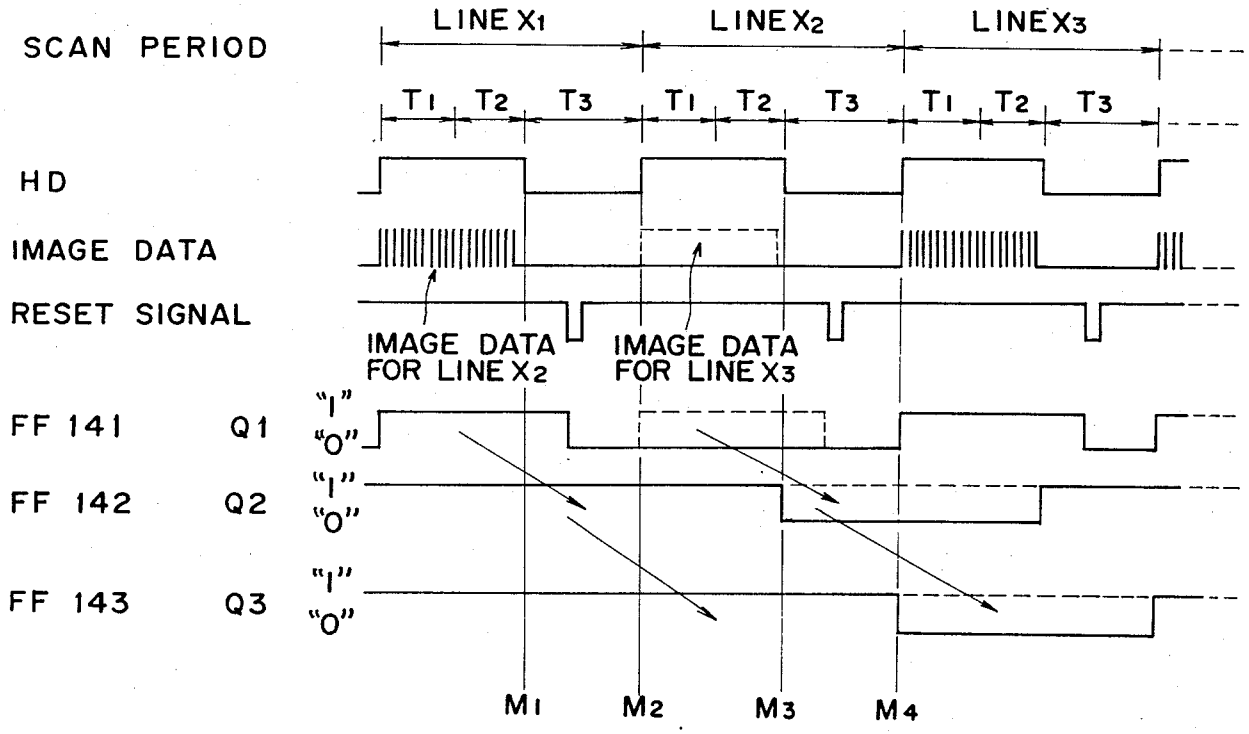
FIG. 6 is a graph showing waveforms of the various signals used in the circuit of FIG. 5.

A display control circuit 160 is provided for producing image data ID which is produced for each line scan period during stages T1 and T2 (or T1' and T2'), as shown in FIG. 6. The image data ID comprises a combination of "1s" and "0s" and is applied to shift register 61 for causing the illumination of picture elements in response to the "1s" presented in the image data ID. When the image data ID comprises only by "0s" and no "1s", the line scanned by that image data ID will have no illuminating picture element. In other words, that line will be a blank line. Thus, a blank line scanning operation will be carried out. As apparent to those skilled in the art, the image data Id produced for one line scan period is temporarily stored in shift register 61 will be used for the line scan on the EL panel in the next line scan period. According to the present invention, the image data ID is also applied to the clock terminal CL of flip-flop 141.

Display control circuit 160 also produces a reset signal during the low level period of the HD signal, as shown in FIG. 6. The reset signal is applied to the reset terminal R of flip-flop 141.

Display control circuit 160 further produces an image data sending period setting signal HD which produces a HIGH level signal when it is permitted to send image data and a LOW level signal when it is prohibited from sending the same. According to the present embodiment, the signal HD produces a HIGH level signal during stages T1 and T2 (or T1' and T2') and a LOW level signal during stage T3 (or T3'), as shown in FIG. 6. The signal HD is applied to the clock terminal CL of flip-flop 143 and also to inverter 144. Thus, inverter 144 produces a signal $\overline{HD}$ which is applied to the clock terminal CL of flip-flop 142.

In addition to the above, display control circuit 160 produces the signals S1, S2, S31, S32 and S4, and the signals for driving shift registers 21, 31, 41 and 51.

Gate array 152 includes four AND gates 146, 147, 148 and 149 each having two inputs. One inputs of AND gates 146–149 is connected to the Q output of flip-flop 143, and the other inputs of AND gates 146–149 are connected to the display control circuit 160 to receive signals S1, S2, S31 and S4, respectively. The outputs of AND gates 146, 147, 148 and 149 are connected, respectively, to a pre-charge circuit 80, a pull-up charge circuit 90, a write-in circuit 100 and a source level switching circuit 110 which operate in response to signals S1, S2, S31 (and/or S32) and S4.

The operation of the EL panel drive circuit according to the present invention will be described hereinbelow with reference to FIG. 6.

In the example, it is assumed that the line X2 has at least one picture element, such as A, to be illuminated and that the line X3 is a blank line having no picture element to be illuminated.

During the scan period of line X1, the image data for line X2 is being produced from the display control circuit 160 and is being stored in shift register 61. At the same time, the image data is applied to the CL terminal of flip-flop 141. Since the image data for line X2 has at least one "1", the signal Q1 produced from the Q terminal of flip-flop 141 will be "1" at time M1, i.e., at the end of generation of the image data for line X2.

Also, at time M1, in response to the step up of the signal $\overline{HD}$ applied to the CL terminal of flip-flop 142, the HIGH level signal from flip-flop 141 is transferred to flip-flop 142. If flip-flop 142 has been producing a HIGH level signal, as in the case shown in FIG. 6, it continues to produce the HIGH level signal from its Q terminal. Then, within a low level period of the HD signal for the scan period for line X1, a reset signal is produced for resetting flip-flop 141.

Thereafter, at time M2, in response to the step up of the signal HD being applied to CL terminal of flip-flop 143, the HIGH level signal from flip-flop 142 is transferred to flip-flop 143. Thus, flip-flop 143 produces a HIGH level signal (signal Q3) during the scan period for line X2, which is applied to the gate array to enable the AND gates 146–149. Thus, during the scan period for line X2, signals S1, S2, S31 and S4 are provided to circuits 80, 90, 100 and 110, respectively, to carry out the scan of line X2 in the known manner described above.

Also, from the time M2, display control circit 160 starts to produce the image signal for line X3 which does not have any "1's". Thus, during the period from time M2 to M3, no HIGH level signal is applied to the clock terminal CL of flip-flop 141. Thus, flip-flop 141 is maintained in the reset condition to produce a LOW level signal from its Q terminal at time M3. At time M3, in response to the step up of the signal $\overline{HD}$ being applied to the CL terminal of flip-flop 142, the LOW level signal from flip-flop 141 is transferred to flip-flop 142. Then, within the stage T3 for the scan period for line X2, a reset signal is produced for resetting flip-flop 141.

Figure 7:
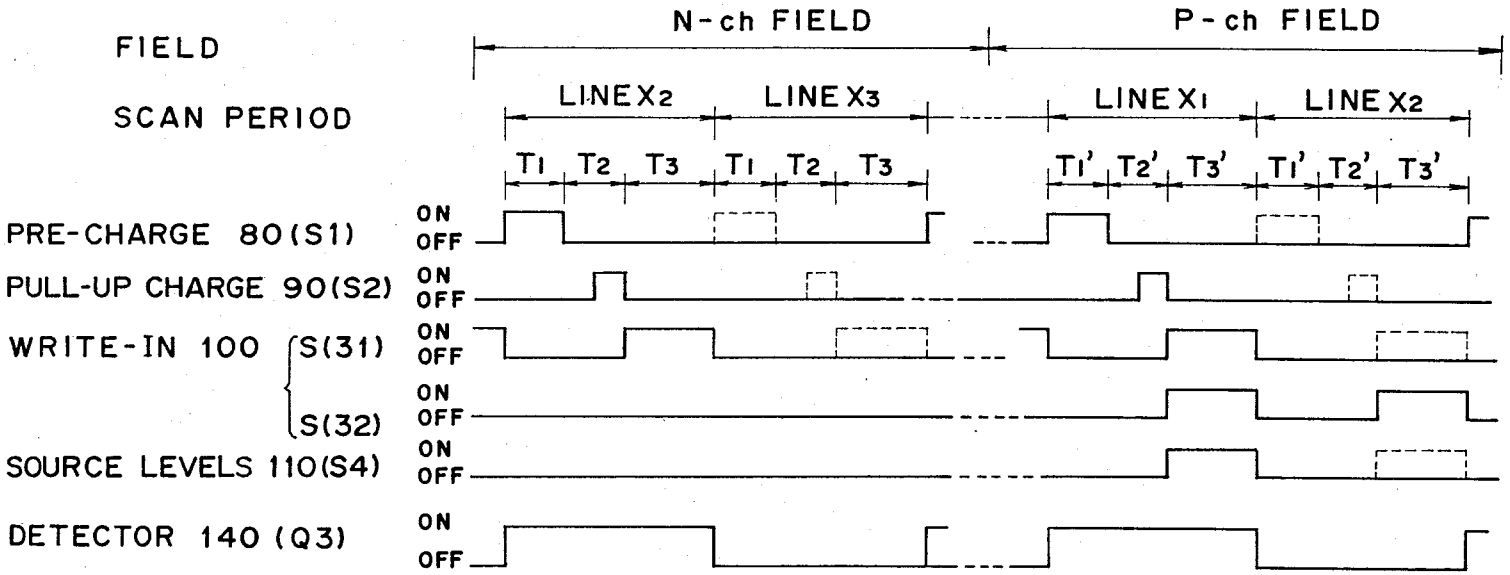
FIG. 7 is a graph showing the on and off states of the various circuits provided in the circuit of FIG. 5.
Figure 8:
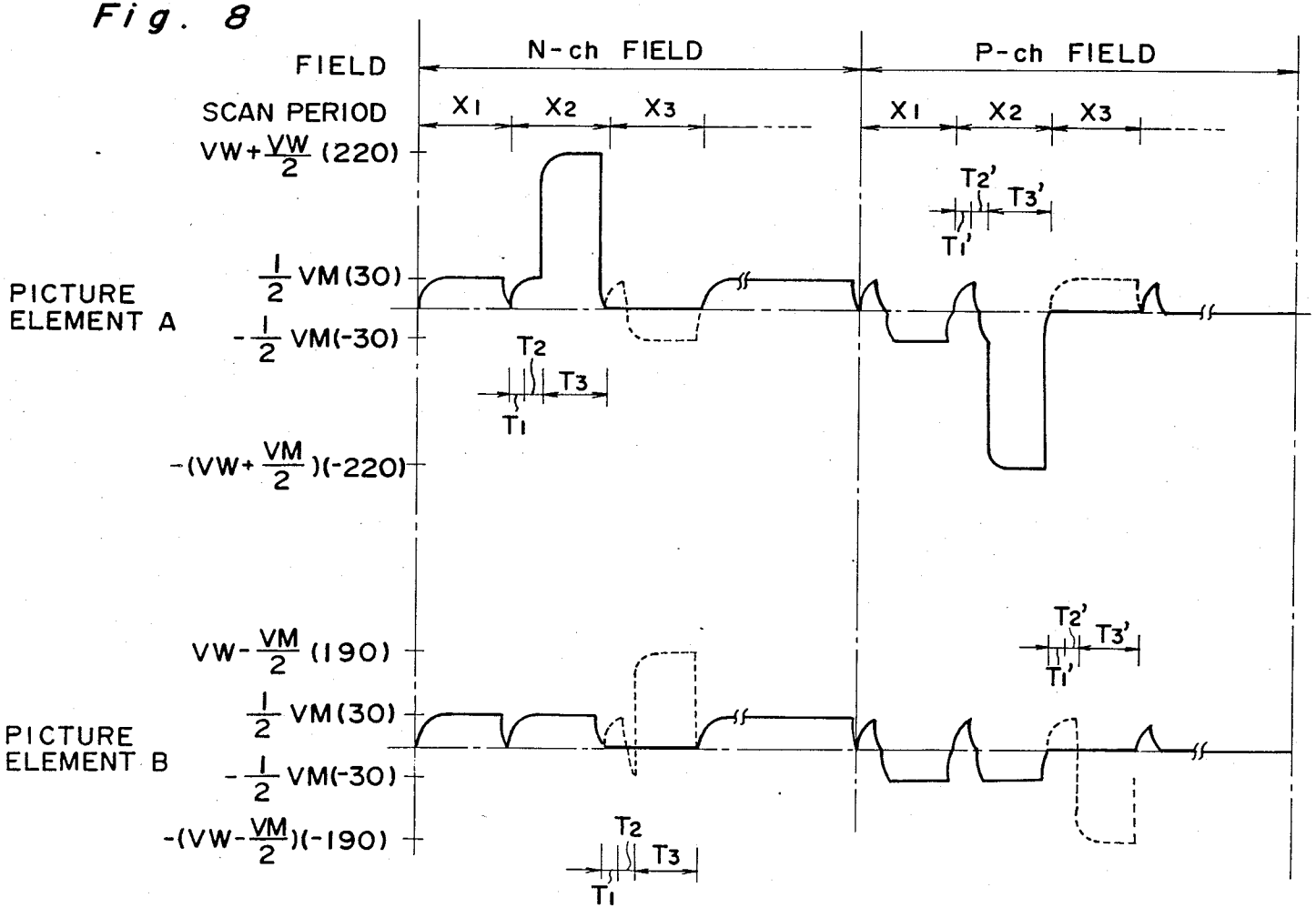
FIG. 8 is a graph showing waveforms of the voltage applied across the EL panel using the EL panel drive circuit of FIG. 5.

Thereafter, at time M4, in response to the step up of the signal HD being applied to CL terminal of flip-flop 143, the Low level signal from flip-flop 142 is transferred to flip-flop 143. Thus, flip-flop 143 produces a Low level signal (signal Q3) during the scan period for line X3, which is applied to the gate array to disable the AND gates 146–149. Thus, during the scan period for line X3, gate array 152 stops signals S1, S2, S31 and S4 from being applied to circuits 80, 90, 100 and 110, respectively. Therefore, the scan operation of line X3 is carried out without turning on any of the circuits 80, 90, 100 and 110, as indicated by the real line in FIG. 7. Thus, during the scan operation of line X3, no voltage difference is produced between electrodes 2 and 6 of the EL panel, as indicated in FIG. 8.

As apparent from the foregoing description, the EL panel driving system according to the present invention can cut off the power supplied from circuits 80, 90, 100, and 110 to the EL panel during the blank line scan period; therefore, the power needed to operate the system can be reduced.

Also, since the EL panel may have periods in which no voltage is applied across the EL layer, the EL panel provided in the system of the present invention lasts longer than that provided in the prior art system.

Although the present invention has been fully described with reference to a preferred embodiment, many modifications and variations thereof will now be apparent to those skilled in the art, and the scope of the present invention therefore is not to be limited by the details of the preferred embodiment described above, but only by the terms of the appended claims.

What is claimed is:

1. An electroluminescent panel display system comprising:

electroluminescent panel means, for displaying information, having a plurality of display lines;

display drive means, operatively connected to said electroluminescent panel means, for producing image data for each display line, said image data for each display line represented by a group of signals, each signal being either a first level or a second level, said first level representing a spot of intended illumination on said electroluminescent panel means, said second level representing a spot of intended non-illumination on said electroluminescent panel means;

said display means providing drive signals, producing at a first instant in time a first voltage in accordance with said drive signals and producing at a second instant in time a second voltage in accordance with said drive signals, said first voltage preparing said electroluminescent panel means to illuminate, said second voltage causing a spot of illumination on said electroluminescent panel means; and display control means, operatively connected to said display drive means to receive said image data and said drive signals, for detecting when at least one first level is present in said image data; said display control means permitting the production of said first and said second voltage by said display drive means when at least one first level is present in said image data and preventing the production of said first voltage and said second voltage by said display drive means when at least one first level is not detected in said image data, said display control means thereby preventing power loss when an individual display line contains no intended spots of illumination.

2. The electroluminescent panel display system as claimed in claim 1, wherein said display lines comprise scan lines and data lines.

3. The electroluminescent panel display system as claimed in claim 2, wherein said display drive means comprises:

first scan means, operatively connected to said electroluminescent panel means and responsive to said drive signals, for sequentially providing said first voltage to each scan line of said electroluminescent panel; and second scan means, operatively connected to said electroluminescent panel means and responsive to said drive signals, for providing said second voltage to each scan line of said electroluminescent panel means in response to said first levels.

4. The electroluminescent panel display system as claimed in claim 3, wherein said display control means comprises:

first switch means, responsive to said image data, for detecting when at least one first level is present in said image data, for producing a present signal when at least one first level is present in said image data and for producing an absent when at least one first level is not present in said image data; and second switch means, operatively connected to said display drive means and responsive to said present signal and said absent signal produced by said first switch means, for regulating application of said drive signals to said first and second scan means;

said second switch means providing said first and second scan means with said drive signals in response to said present signal and preventing the application of said drive signals to said first and second scan means in response to said absent signal.

5. An electroluminescent panel display system comprising:

electroluminescent panel means, for displaying information having a plurality of display lines, said display lines being scan lines and data lines;

display control means, for producing image data for each display line, for detecting the contents of said image data, and for providing drive signals, said image data for each display line represented by a group of signals, each signal being either a first level or a second level, said first level representing a spot of intended illumination on said electroluminescent panel means, said second level representing a spot of intended non-illumination on said electroluminescent panel means, said drive signals being provided only when at least one first level is present in said image data; and circuit means, operatively connected to said electroluminescent panel means and said display control means and responsive to said drive signals and said image data, for producing at a first instant in time a first voltage in accordance with said image data only when said drive signals are provided and for producing at a second instant in time a second voltage in accordance with said image data only when said drive signals are provided, said first voltage preparing said electroluminescent panel means to illuminate, said second voltage causing a spot of illumination on said electroluminescent panel means;

said circuit means including, first scan means, operatively connected to said electroluminescent panel means and responsive to said drive signals, for sequentially providing said first voltage to each scan line of said electroluminescent panel means, and second scan means, operatively connected to said electroluminescent panel means and said display control means and responsive to said drive signals and said image data, for providing said second voltage to each scan line of said electroluminescent panel means in response to said first levels;

said display control means including, first switch means, responsive to said image data, for detecting when at least one first level is present, for producing a present signal when at least one first level is present in said image data, and for producing an absent signal when at least one first level is not present in said image data, and second switch means, operatively connected to said circuit means and responsive to said present signal and said absent signal, for regulating transmission of said drive signals to said first and second scan means, said second switch means allowing transmission of said drive signals to said first and second scan means in response to said present signal and for preventing transmission of said drive signals to said first and second scan means in response to said absent signal, thereby preventing the functions of said first and second scan means when no first level is detected in said image data.

6. An electroluminescent panel system for displaying information comprising:

an electroluminescent panel having plurality of display lines;

display control means for producing control signals and image data for each display line, said image data for each said display line formed of a group of signals, each signal being either the first level or a second level, said first level representing a spot of intended illumination on said electroluminescent panel, said second level representing a spot of intended non-illumination on said electroluminescent panel;

drive means, operatively connected to said electroluminescent panel and said display control means to receive said image data and responsive to said display control means, for sequentially providing at a first instant in time a first voltage to certain display lines of said electroluminescent panel and for providing a second voltage at a second instant in time to certain display lines of said electroluminescent panel in response to said first level, said first voltage preparing said electroluminescent panel to illuminate, said second voltage selectively causing a spot of a illumination on said electroluminescent panel, said control signals determining when said first voltage and said second voltage are provided to said electroluminescent panel; and control means, operatively connected to said display control means and said drive means, for detecting at least one first level in said image data;

said control means permitting said control signals to be provided to said drive circuit means when at least one first level is detected and not permitting said control signals to be provided to said drive means when no first levels are detected, thereby preventing the function of said drive means when no first levels are present.

7. The electroluminescent panel system as claimed in claim 6, wherein said displayed lines comprise scan lines and data lines.

8. The electroluminescent panel system as claimed in claim 7, wherein said drive means comprise:

first scan means, operatively connected to said electroluminescent panel and responsive to said control signals, for sequentially providing said first voltage to each scan line of said electroluminescent panel; and second scan means, operatively connected to said display control means and said electroluminescent panel and responsive to said control signals, for providing said second voltage to each scan line of said electroluminescent panel in response to said first levels.

9. The electroluminescent panel system as claimed in claim 8, wherein said control means comprises:

detetection means, operatively connected to said display control means and responsive to said image data, for detecting at least one first level in said image data, for producing a present signal when at least one first level is present in said image data and for producing an absent signal when at least one first level is not present in said image data; and switch means, operatively connected to said first and second scan means and said display control means and responsive to said present signal and said absent signal, for regulating transmission of said control signals from said display control means to first and second scan means;

said switch means allowing the transmission of said control signals to said first and second scan means in response to said present signal and preventing the transmission of said control signals to said first and second scan means in response to said absent signal, thererby preventing the function of said first and second scan means when at least one first level is not present in said image data.

10. An electroluminescent panel driving system for driving electroluminescent panel having a plurality of scan lines and data lines comprising:

image data producing means, for sequentially producing image data for each scan line, said image data for each scan line formed of a group of bits, each bit having either a first level or a second level, said first level representing a spot of intended illumination on the electroluminescent panel, said second level representing a spot of intended non-illumination on the electroluminescent panel;

first scan means, operatively connected to the electroluminescent panel, for sequentially providing a first voltage to each scan line of the electroluminescent panel, said first voltage preparing the electroluminescent panel to illuminate;

second scan means, operatively connected to said image data producing means and the electroluminescent panel, for providing a second voltage to each scan line of the electroluminescent panel in response to said first level, said second voltage selectively causing a spot of illumination on the electroluminescent panel;

detecting means, operatively connected to said image data producing means, for detecting the presence of at least one first level in said image data;

said detecting means producing a present signal when at least one first level is present and producing an absent signal when at least one first level is not present in said image data; and control means, operatively connected to the said first and second scan means and responsive to said present and absent signals of said detecting means, for enabling said first and second scan means when said present signal is received and disabling said first and second scan means when said absent signal is received.

11. An electroluminescent matrix display drive system for supplying drive voltages to elements of an electroluminescent matrix display, the elements being arranged in scan lines, comprising:

a power supply;

display control means, for developing image data representative of an image to be displayed on the display, said image data selectively representing the intended illumination or lack of intended illumination of each element on the display;

display drive means, powered by said power supply, for supplying a net drive voltage across each element to selectively cause the element to illuminate in response to said image data developed by said display control means; and power conservation means, responsive to said image data, for disconnecting said power supply from said display drive means when the image data for an entire scan line is representative only of the lack of illumination of each scan line element, thereby to substantially reduce power consumption of said drive system.

12. The electroluminescent matrix display drive system as claimed in claim 11, wherein the electroluminescent matrix display further comprises data lines and said driver system further comprising data line drive means for driving said data lines to selectively cause illumination in the elements along the scan lines.

13. The electroluminescent matrix display drive system as claimed in claim 12, wherein said display drive means comprises:

first scan means, operatively connected to the electroluminescent matrix display and responsive to said display control means, for sequentially providing a first voltage to each scan line of the electroluminescent matrix display; and second scan means, operatively connected to the electroluminescent matrix display and responsive to said display control means, for providing a second voltage to each scan line of the electroluminescent matrix display in response to said image data.

14. The electroluminescent matrix display drive system as claimed in claim 13, wherein said power conservation means comprises:

first switch means, responsive to said image data, for detecting when said image data represents that at least one element in the scan line is intended for illumination and for producing a present signal only when at least one element on the scan line is intended for illumination; and second switch means, operatively connected to said display drive means and responsive to said present signal produced by said first switch means, for regulating application of said power supply to said first and second scan means;

said second switch means allowing said first and second scan means to connect with said power supply in response to said present signal, thereby preventing the application of said power supply to said first and second scan means when no element on the scan line is intended for illumination.

* * * * *